US010500442B2

(12) United States Patent
Hong et al.

(10) Patent No.: US 10,500,442 B2
(45) Date of Patent: Dec. 10, 2019

(54) ACTUATOR AND EXERCISE EQUIPMENT USING SAME

(71) Applicant: MICROAUTOMATION CO., LTD., Daejeon (KR)

(72) Inventors: Yoon Shik Hong, Daejeon (KR); Sung Nam Oh, Seoul (KR); Han Jong Ju, Daejeon (KR); Hyun Soo Park, Daejeon (KR)

(73) Assignee: MICROAUTOMATION CO., LTD., Daejeon (KR)

( * ) Notice: Subject to any disclaimer, the term of this patent is extended or adjusted under 35 U.S.C. 154(b) by 0 days.

(21) Appl. No.: 15/542,217

(22) PCT Filed: Dec. 31, 2015

(86) PCT No.: PCT/KR2015/014568
§ 371 (c)(1),
(2) Date: Jul. 7, 2017

(87) PCT Pub. No.: WO2016/111503
PCT Pub. Date: Jul. 14, 2016

(65) Prior Publication Data

US 2017/0361166 A1 Dec. 21, 2017

(30) Foreign Application Priority Data

Jan. 7, 2015 (KR) ..... 10-2015-0002003

(51) Int. Cl.
*A63B 24/00* (2006.01)
*A63B 21/00* (2006.01)
(Continued)

(52) U.S. Cl.
CPC ..... *A63B 24/0087* (2013.01); *A63B 21/00* (2013.01); *A63B 21/005* (2013.01);
(Continued)

(58) Field of Classification Search
CPC ..... A63B 21/062–0632; A63B 21/15; A63B 21/154–156; A63B 21/4047–4049
See application file for complete search history.

(56) References Cited

U.S. PATENT DOCUMENTS 7,601,105 B1 * 10/2009 Gipson, III ..... A63B 21/055 482/103
7,632,221 B1 * 12/2009 Kolander ..... A63B 21/154 482/102
(Continued)

FOREIGN PATENT DOCUMENTS

KR 10-1125736 B1 3/2012
KR 10-1166981 B1 7/2012
(Continued)

OTHER PUBLICATIONS

International Search Report for PCT/KR2015/014568 dated Apr. 15, 2016.
(Continued)

*Primary Examiner* — Jennifer M Deichl
(74) *Attorney, Agent, or Firm* — Hauptman Ham, LLP

(57) ABSTRACT

An actuator and an exercise equipment using the same are disclosed. The exercise equipment comprises a post which is a main body of the exercise equipment, a shoulder installed on an upper side of the post and rotates in left and right direction, an arm combined with the shoulder and rotates in up and down direction, a hand combined with one terminal of the arm and rotates by using the arm as an axis, a handle located on one terminal side of the hand, a force control actuator outputs a force corresponding to weight set by a user, and a wire passes via plural sheaves included in the hand, the shoulder and the post and deliver a force generated by pulling of the handle, one terminal of the wire being connected to the handle.

2 Claims, 8 Drawing Sheets

(51) Int. Cl.
*A63B 21/005* (2006.01)
*A63B 21/018* (2006.01)
*A63B 23/12* (2006.01)

(52) U.S. Cl.
CPC .... *A63B 21/0058* (2013.01); *A63B 21/00076* (2013.01); *A63B 21/018* (2013.01); *A63B 21/153* (2013.01); *A63B 21/154* (2013.01); *A63B 21/156* (2013.01); *A63B 21/4035* (2015.10); *A63B 23/12* (2013.01); *A63B 24/0062* (2013.01); *A63B 2024/0093* (2013.01); *A63B 2220/51* (2013.01); *A63B 2220/54* (2013.01)

(56) References Cited

U.S. PATENT DOCUMENTS 8,057,367 B2 * 11/2011 Giannelli ..... A63B 23/03533 482/102
8,096,926 B1 * 1/2012 Batca ..... A63B 21/00058 482/92
8,308,620 B2 * 11/2012 Lyszczarz ..... A63B 21/156 482/103
8,500,607 B2 * 8/2013 Vittone ..... A63B 21/151 482/102
9,393,453 B2 * 7/2016 Watterson ..... A63B 21/00196
9,446,285 B1 * 9/2016 Drath ..... A63B 23/0211
2003/0017918 A1 * 1/2003 Webb ..... A63B 21/154 482/94
2016/0346590 A1 * 12/2016 Giannelli ..... A63B 21/063

FOREIGN PATENT DOCUMENTS

KR 10-2012-0108772 A 10/2012
KR 10-1330532 B1 11/2013
KR 10-1425769 B1 8/2014
KR 10-2014-0124161 A 10/2014

OTHER PUBLICATIONS

Korean Office Action dated Jun. 13, 2016 in connection with the counterpart Korean Patent Application No. 10-2015-0002003.

* cited by examiner

ACTUATOR AND EXERCISE EQUIPMENT USING SAME

CROSS REFERENCE TO RELATED APPLICATION

This present application is a national stage filing under 35 U.S.C § 371 of PCT application number PCT/KR2015/014568 filed on Dec. 31, 2015 which is based upon and claims the benefit of priority to Korean Patent Application No. 10-2015-0002003 filed on Jan. 7, 2015 in the Korean Intellectual Property Office. The disclosures of the above-listed applications are hereby incorporated by reference herein in their entirety.

TECHNICAL FIELD

The present disclosure relates to an actuator and an exercise equipment using the same.

BACKGROUND ART

Generally, a weight exercise equipment means an equipment for training user's muscles by performing repetitively an operation of lifting and falling selectively multiple weights connected with a wire after passing a fixing pin through a weight desired by a user.

A typical weight exercise equipment is a chest weight exercise equipment for pulling its handle in the direction of a chest and spreading the handle while the user holds the handle under the condition that he spreads horizontally his arms, to obtain exercise effect through contraction and relaxation of muscles.

However, the handle in the chest weight exercise equipment moves in only predetermined direction, but it can't move in multiple directions. As a result, only chest can be exercised.

Additionally, it is inconvenient to remove the fixing pin inserted into the weight and insert newly the fixing pin into a desired weight, so as to change (increase or decrease) the weight. It is very inconvenient to exercise with increasing step by step the weight. Since it is impossible to increase or decrease gradually the weight while the user is exercising, isokinetic exercise, isometric exercise and isotonic exercise are limited.

Furthermore, extra space in which the weights locate is necessary, and thus volume of the exercise equipment increases. Accordingly, an area required for establishing the exercise equipment increases.

SUMMARY

Accordingly, the invention is provided to substantially obviate one or more problems due to limitations and disadvantages of the related art. One embodiment of the invention provides an exercise equipment for moving freely in multiple directions a handle for delivering a force, and thus the exercise equipment can be used for exercising various body parts.

Another embodiment of the invention provides an exercise equipment for solving inconvenience of increasing or decreasing weight using weights whenever a user changes the weight, and programming an exercise to change the weight while the user is exercising. As a result, maximum exercise effect may be obtained.

Still another embodiment of the invention provides an exercise equipment for minimizing its volume and weight.

In one embodiment, the invention provides an exercise equipment comprising: a post which is a main body of the exercise equipment; a shoulder installed on an upper side of the post and configured to rotate in left and right direction; an arm combined with the shoulder and configured to rotate in up and down direction; a hand combined with one terminal of the arm and configured to rotate by using the arm as an axis; a handle located on one terminal side of the hand; a force control actuator configured to output a force corresponding to weight set by a user; and a wire configured to pass via plural sheaves included in the hand, the shoulder and the post and deliver a force generated by pulling of the handle, one terminal of the wire being connected to the handle. Here, the post includes a fixing sheave block fixed in the post, an upper part moving sheave block located below the fixing sheave block and a lower part moving sheave connected to a lower part of the upper part moving sheave block. The wire passes via the fixing sheave block by one or more times and passes via the upper part moving sheave block by one or more times, and a belt of the force control actuator passes via the lower part moving sheave.

In another embodiment, the invention provides a force control actuator used in an exercise equipment comprising: a load cell located on a path of a belt and configured to measure tension of the belt, a force which a user pulls a wire being delivered to the belt; a controller configured to calculate tension to be outputted by using tension corresponding to weight set by the user and the tension measured by the load cell; a motor configured to generate torque based on the calculated tension; a reducer connected to a driving axis of the motor and configured to increase a torque by reducing velocity generated by the motor; and a drum connected to the reducer and configured to output tension calculated by the controller.

In an exercise equipment of the invention, a handle for delivering a force can freely move in multiple directions. Accordingly, the exercise equipment may be used for exercising various body parts.

In addition, the exercise equipment may solve inconvenience for increasing or decreasing one by one weight using weights.

Moreover, the exercise equipment may program increasing or decreasing of the weight and velocity, thereby obtaining various exercise effect.

Furthermore, shock due to the weights does not occur when the user suddenly pulls or stops the handle, and so muscles and joints may not be hurt.

Additionally, volume and weight of the exercise equipment are minimized, and thus a space for establishing the exercise equipment may be reduced and it is easy to move the exercise equipment.

Effect of the invention is not to effect mentioned above, and may include every effect capable of being inferred from description or claims of the invention.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Like numbers refer to like elements throughout the description of the figures.

It will be understood that when an element is referred to as being "connected" or "coupled" to another element, it can be directly connected or coupled to the other element or intervening elements may be present.

It will be further understood that the terms "comprises", "comprising,", "includes" and/or "including", when used herein, specify the presence of stated features, integers, steps, operations, elements, and/or configurations, but do not preclude the presence or addition of one or more other features, integers, steps, operations, elements, configurations, and/or groups thereof.

Hereinafter, various embodiments of the invention will be described in detail with reference to accompanying drawings.

Figure 1:
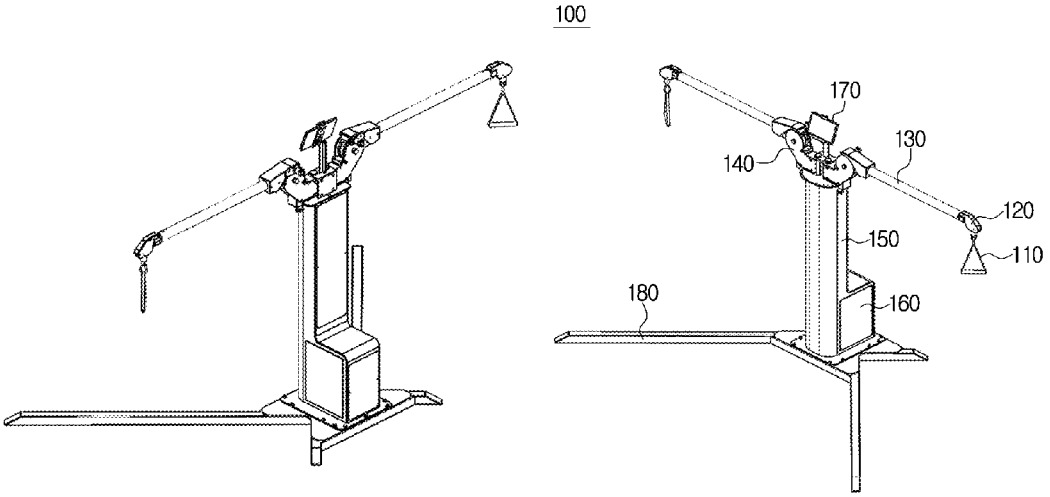
FIG. 1 is a view illustrating an exercise equipment according to one embodiment of the invention.

FIG. 1 is a view illustrating an exercise equipment according to one embodiment of the invention.

The exercise equipment 100 of the present embodiment may include a handle 110, a hand 120, an arm 130, a shoulder 140, a post 150, a force control actuator 160, a touch panel 170 and a base frame 180.

A user inputs an exercise program including desired weight and desired exercise velocity, etc. through the touch panel 170, and fixes the arm 130 and the shoulder 140 by adjusting an upper angle or a lower angle of the arm 130 and a left angle or a right angle of the shoulder 140 according to body part to be exercised. Subsequently, the user repeats an operation of pulling and returning by constant distance the handle 110, thereby contracting or relaxing muscles of the body part to be exercised.

Here, the angle of the arm 130 and the angle of the shoulder 140 may be manually adjusted, or be automatically adjusted by an angle inputted through the touch panel 170 by using the force control actuator 160.

The user may exercise with one handle 110 or with both of the handles 110.

In this case, a wire connected to the handle 110 is pulled in a direction the user pulling the handle 110 in response to a user's operation. The force control actuator 160 provides a force corresponding to the weight and the exercise velocity inputted by the user through the touch panel 170, in a direction opposed to the direction the user pulling the handle 110.

Accordingly, the exercise equipment of the invention may generate the same effect as in the conventional exercise equipment using weights, without using weights. Additionally, the force control actuator 160 functions itself as a damper, thereby attenuating a shock applied to the user.

In the conventional exercise equipment, a wire becomes suddenly tightened due to falling of the weight if the user lifts rapidly the weight and then falls the weight, and so a shock may be applied to a user's joint. If the user loses the handle due to the weight while he lifts the weight by pulling the handle or the handle is deviated from a user's hand due to sliding, the weight is fallen, and so the fallen weight collides with a laminated weight or applies a shock to a floor. That is, much inconvenience and dangerous problems occur. However, the exercise equipment of the invention may solve these problems.

Moreover, the exercise equipment of the invention solves inconvenience of increasing or decreasing one by one the weight by using the weights when changing the weight. The exercise equipment may automatically set the weight or velocity according to an exercise program, and minimize its volume and weight.

The handle 110 may have triangular ring shape as shown in FIG. 1, so that the user can pull the handle 110 while he grips the handle 110 connected to the wire.

Of course, the handle 110 may have various shapes such as a circular ring, a rod having certain length, a string tied in a ring shape, etc. aside from the triangular ring shape, as long as the user grips the handle 110.

The hand 120 may have plural fixing sheaves. The other terminal of the hand 120 may be combined with one terminal of the arm 130.

Here, the other terminal of the hand 120 may be combined with the one terminal of the arm 130 by using a bearing, and thus the hand 120 may rotate by 360° while it is combined with the arm 130.

A wire passing through the arm 130 may be connected to the handle 110 located on the one terminal side of the hand 120 via at least one fixing sheave of the hand 120.

The wire may be pulled after its direction is changed by maximum 180° according to a direction the user pulling the handle 110. In this case, the wire may pass via one or more of the fixing sheaves.

As a result, the wire can be changed in every direction, through combination of 360° rotation of the hand 120 using the bearing and 180° direction change of the wire passing via the fixing sheave in the hand 120.

Furthermore, the hand 120 may have a small weight. The weight may perform a function of reducing inertia when the hand 120 rotates, because it makes a centroid of the hand 120 close to a rotation axis.

Figure 2:
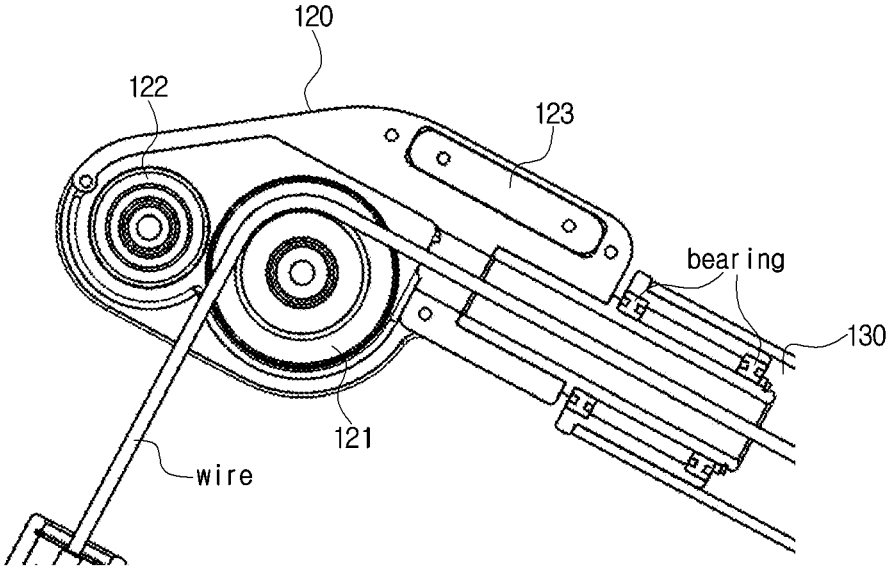
FIG. 2 and FIG. 3 are views illustrating a hand according to one embodiment of the invention.
Figure 3:
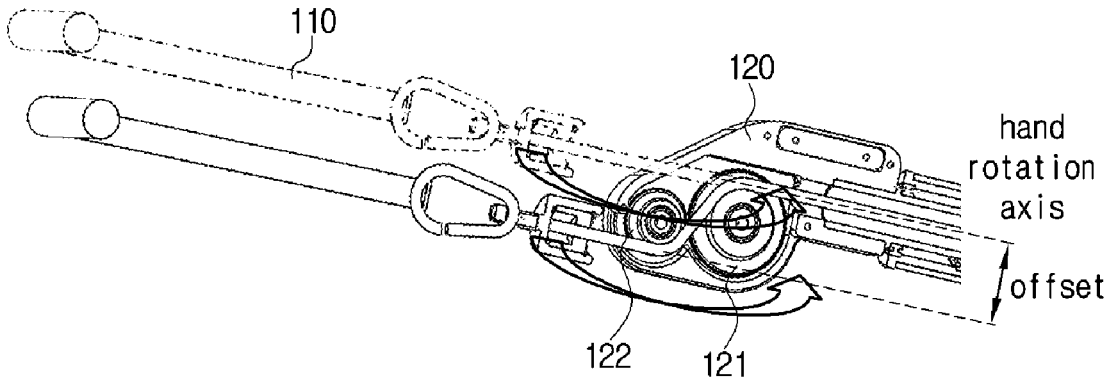

Any further detailed description concerning the hand 120 will follow with reference to FIG. 2 and FIG. 3.

The arm 130 may have a hollow cylinder shape through which the wire passes. One terminal of the arm 130 is combined with the other terminal of the hand 120, and the other terminal of the arm 130 is combined with the shoulder 140 with a pin having a hollow shaft, and thus the arm 130 may rotate in up and down direction.

The bearing used when the arm 130 is combined with the hand 120 may be established inside the one terminal of the arm 130.

A plurality of fixing holes for combination with the shoulder 140 may be formed in a constant angle space on the other terminal of the arm 130. The arm 130 may be fixed to the shoulder 140 by using the clamp after it is adjusted in up and down direction.

Any further detailed description concerning combination of the arm 130 and the shoulder 140 will be described below with reference to a drawing FIG. 4.

The shoulder 140 may have 'L' shape as shown in FIG. 1. One terminal of the shoulder 140 is combined with the other terminal of the arm 130 to support the arm 130, the other terminal of the shoulder 140 is combined with an upper side of the post 150 by using a pin with a hollow shaft, and so the shoulder 140 may rotate in left and right direction.

Plural fixing holes for combination with the arm 130 may be formed on one terminal of the shoulder 140 in a constant angle space, and may be combined with the fixing holes formed in a constant angle space on the other terminal of the arm 130 by using the clamp. As a result, the shoulder 140 may be fixed.

Plural fixing holes for combination with the post 150 may be formed in a constant angle space on the other terminal of the shoulder 140, and be combined with fixing holes formed in a constant angle space on an upper side of the post 150 by using the clamp. As a result, the shoulder 140 may be fixed.

The wire may be connected to the handle 110 via the arm 130 and the hand 120 through a pin with the hollow shaft corresponding to a rotation axis of the shoulder 140.

Here, the shoulder 140 may have a plurality of fixing sheaves through which the wire passes. Detailed description concerning the fixing sheave will be described to below with reference to a drawing FIG. 4.

Fixing holes for combination with the other terminal of the shoulder 140 may be formed in a constant angle space on an upper side of the post 150. In addition, the touch panel 170 may be installed on the upper side of the shoulder 140.

The post 150 may have 'L' shape as shown in FIG. 1. An empty space may be formed in the post 150, to protect a moving sheave, the fixing sheave connected to the moving sheave, the wire and the force control actuator 160 from outside shock and pollution.

The post 150 may be installed by combined with the base frame 180 as shown in FIG. 1. In another embodiment, the post 150 may be fixed by an anchor installed on the floor without using the base frame 180.

The force control actuator 160 may provide a force corresponding to the weight inputted through the touch panel 170 in a direction opposed to a direction the user pulling the handle 110, when the wire connected to the handle 110 is pulled in the direction the user pulling the handle 110 according to a user's operation.

The force control actuator 160 will be described in detail below with reference to drawings FIG. 6 to FIG. 8.

The touch panel 170 may be installed on the upper side of the post 150. The user may input the exercise program including desired weight, velocity, etc. through the touch panel 170.

The touch panel 170 may receive the angle of the arm 130 and the angle of the shoulder 140.

The touch panel 170 may display real time force (tension), with which the user pulls the handle 110, the velocity and location (pulling distance) measured by the force control actuator 160, the angles of the arm 130 and the shoulder 140 set by the user, etc. on a screen. The touch panel 170 may also display calorie consumption, etc.

The touch panel 170 may display a power of exercise muscle evaluated depending on a power (force×velocity) calculated based on the measured real time force, the velocity and the location.

The base frame 180 may support the post 150 by combined with the post 150.

FIG. 2 and FIG. 3 are views illustrating a hand according to one embodiment of the invention.

As shown in FIG. 2, the other terminal of the hand 120 and one terminal of the arm 130 may be combined by using the bearing. The hand 120 may include a plurality of fixing sheaves 121 and 122 and a weight 123.

Here, a diameter of the first fixing sheave 121 is higher than that of the second fixing sheave 122. The diameter of the second fixing sheave 122 may be formed to have a specific space of offset centering on a rotation axis of the hand 120.

The weight 123 may make a centroid of the hand 120 close to the rotation axis, thereby reducing inertia when the hand 120 rotates FIG. 3 is a view illustrating offset formed by the rotation axis of the hand 120 and the diameter of the second fixing sheave 122.

As shown in FIG. 3, if the second fixing sheave 122 or the offset does not exist between the rotation axis of the hand 120 and the diameter of the second fixing sheave 122 when a direction is changed while the wire is pulled, the hand 120 can't rotate and the only wire is bent.

In this case, very much load may be provided to a wrist and an arm when the user does a special operation of exercise by the user pulling the handle 110 and changing the direction, and the wire may be damaged.

However, in the event that the offset exists between the rotation axis of the hand 120 and the diameter of the second fixing sheave 122 as shown in FIG. 3, the hand 120 rotates due to the offset though the user pulls the handle 110 and changes the direction. As a result, it is possible to change (rotate) freely the direction.

Figure 4:
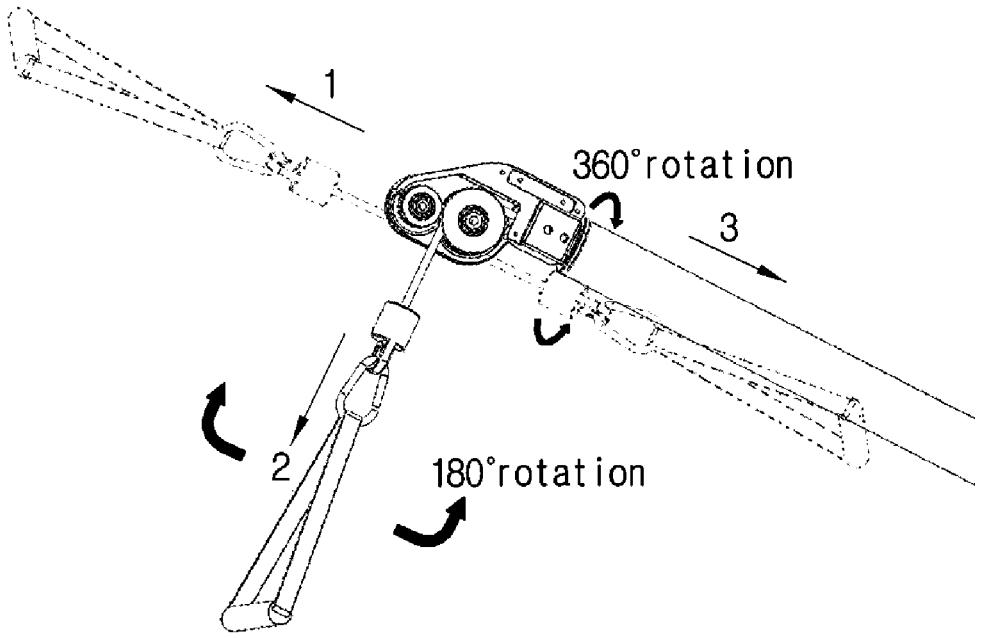
FIG. 4 is a view illustrating rotation of the hand and direction change of the wire according to one embodiment of the invention.

FIG. 4 is a view illustrating rotation of the hand and direction change of the wire according to one embodiment of the invention.

It is possible to change the wire in every direction, through combination of 360° rotation of the hand 120 and 180° direction change of the wire passing via the fixing sheave in the hand 120.

A path of the wire may have 'S' shape according as the wire passes the second fixing sheave 122 after it is wound to the first fixing sheave 121, if the handle 110 is pulled under a first state as shown in FIG. 4. The path of the wire may have 'reverse ¬' shape or 'U' shape according as the wire is wound to only the first fixing sheave 121, if the handle 110 is pulled under a second state or a third state.

Figure 5:
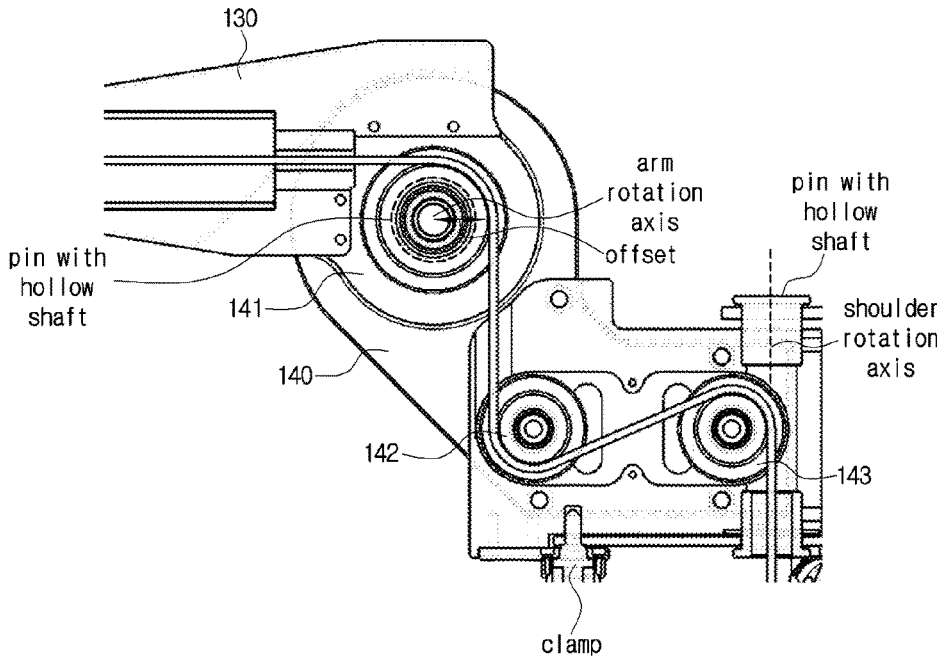
FIG. 5 is a view illustrating the other terminal of the arm and a shoulder according to one embodiment of the invention.

FIG. 5 is a view illustrating the other terminal of the arm and a shoulder according to one embodiment of the invention.

Plural fixing holes for fixing up and down angle of the arm 130 may be formed in a constant angle space on the other terminal of the arm 130. A plurality of fixing holes corresponding to the fixing holes on the other terminal of the arm 130 may be formed in a constant angle space on one terminal of the shoulder 140.

The user may match the fixing hole of the arm 130 with the fixing hole of the shoulder 140 under the condition that he adjusts the arm 130 to desired angle and fix the arm 130 using the clamp, thereby adjusting easily the angle of the arm 130.

The angle of the arm 130 may be automatically fixed to an angle set by the user by the force control actuator 160.

The shoulder 140 may include plural fixing sheaves. In FIG. 4, three fixing sheaves 141, 142 and 143 are shown in FIG. 4.

Here, the shoulder 140 may be combined with the arm 130 by using the pin with the hollow shaft, and thus the arm 130 may rotate in up and down direction on the basis of the pin functioned as the rotation axis. The first fixing sheave 141 may be installed to a hollow shaft part of the pin.

In this case, radius of the first fixing sheave 141 may be matched with the offset of the wire passing vertically via the second fixing sheave 142 from the rotation axis (pin) of the arm 130 and the shoulder 140.

Accordingly, the path of the wire may not be deviated by minimal length change of the wire, though the arm 130 goes vertically up or down when the arm 130 rotates in up and down direction.

An upper side of the shoulder 140 is combined with the upper side of the post 150 by the pin with the hollow shaft, and thus the shoulder 140 may rotate in left and right direction.

In this case, the path of the wire may be matched with the rotation axis of the shoulder 140 according as the wire passes through the hollow shaft of the pin as shown in FIG. 5, and the wire passes a lower part of the second fixing sheave 142 after passing an upper part of the third fixing sheave 143 (that is, the wire is twisted by the fixing sheaves). As a result, the shoulder 140 may rotate though the length of the wire is not changed.

An angle of the shoulder 140 may be automatically fixed to an angle set by the user by the force control actuator 160.

Figure 6:
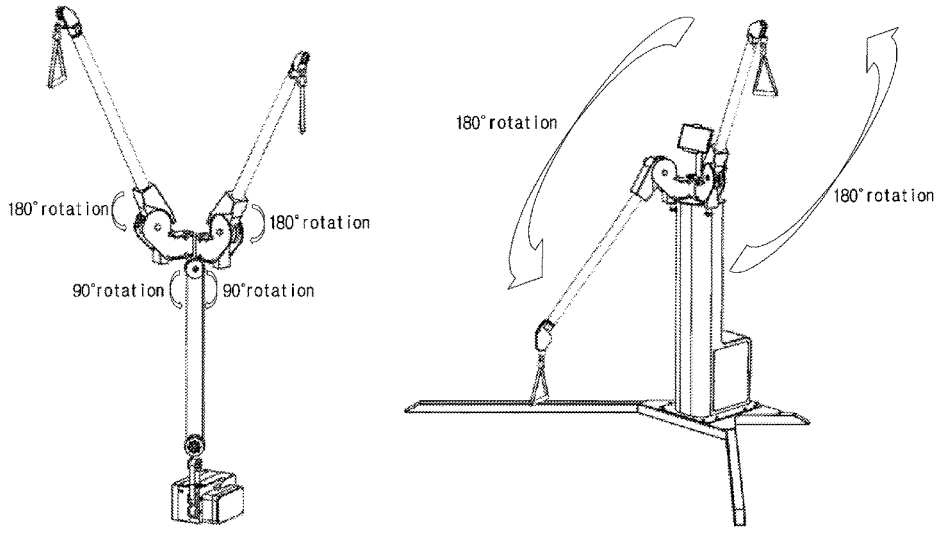
FIG. 6 and FIG. 7 are views illustration rotation of the arm and the shoulder according to one embodiment of the invention.
Figure 7:
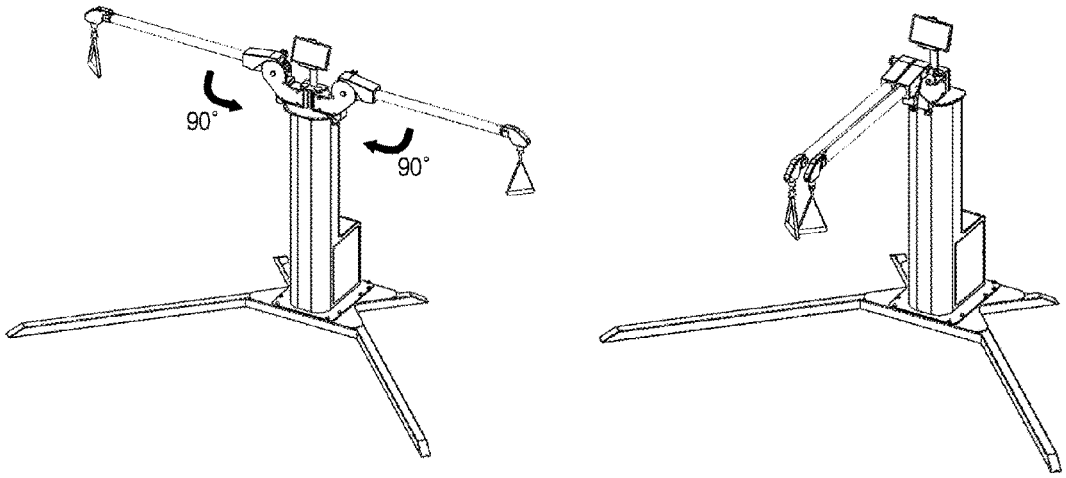

FIG. 6 and FIG. 7 are views illustration rotation of the arm and the shoulder according to one embodiment of the invention.

FIG. 6 shows 180° rotation of the arm 130 in up and down direction, and FIG. 7 illustrates 90° rotation of the shoulder 140 in left and right direction.

The user may adjust and fix easily rotation angle of the arm 130 in up and down direction and rotation angle of the shoulder 140 in left and right direction to desired angles, by using the clamp.

Figure 8:
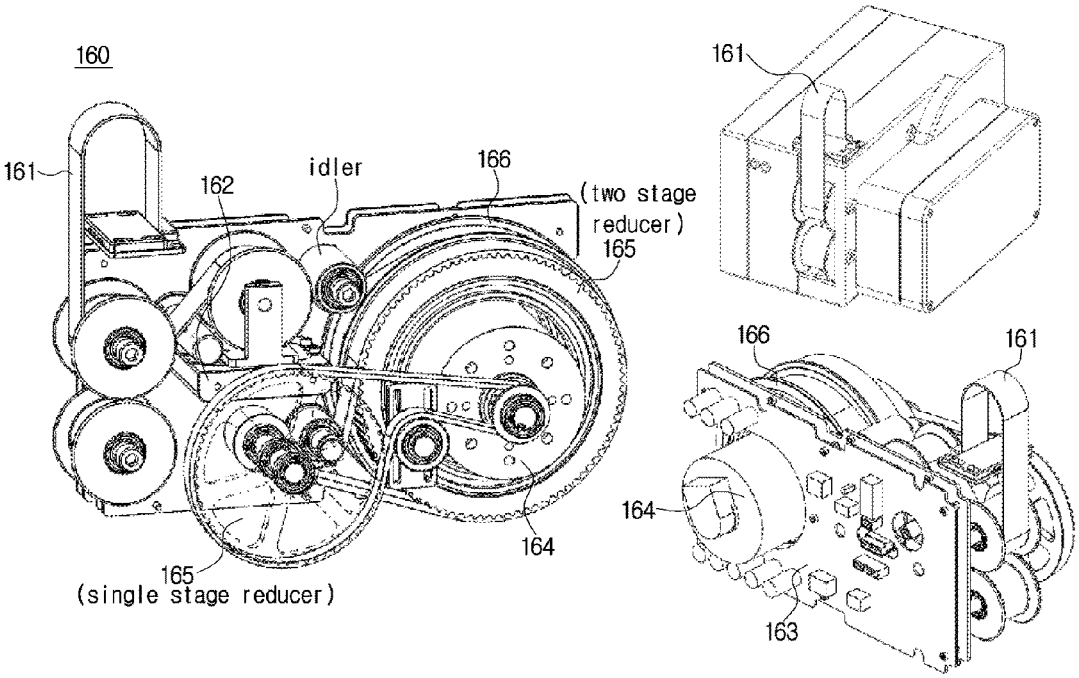
FIG. 8 is a view illustrating a force control actuator according to one embodiment of the invention.

FIG. 8 is a view illustrating a force control actuator according to one embodiment of the invention.

The force control actuator 160 of the present embodiment may include a belt 161, a load cell 162, a controller 163, a motor 164, a reducer 165 and a drum 166.

The belt 161 may pass via the fixing sheave connected to the moving sheave located in the post 150, and deliver a force applied to the wire when the user pulls the handle 110 to the force control actuator 160.

The belt 161 may be a core coating rope or a fiber rope.

The load cell 162 locates on a path of the belt 161 as shown in FIG. 8, and may measure a real-time force applied to the wire according as the user pulls the handle 110, i.e. real-time tension of the belt.

The controller 163 may calculate a force to be outputted by the motor 164 by using an input tension, i.e. a force corresponding to weight inputted through the touch panel 170 by the user and the tension measured by the load cell 162, i.e. the force applied to the wire according as the user pulls the handle 110, and control the motor 164.

The controller 163 may calculate a force and a power (the force=velocity×power) in accordance with a pulled distance, based on a force, measured in real time, applied to the wire, velocity (pulling velocity) and location (pulled distance) according as the user pulls the handle 110, and evaluate a power of the exercise muscle by using the calculated force and the calculated power.

Here, the velocity and the location may be measured by using a location detecting sensor (not shown) such as an encoder, etc., and thus the force control actuator 160 may further include the location detecting sensor such as the encoder, etc.

The motor 164 may generate a torque based on a value calculated by the controller 163. The reducer 165 may be connected to a driving axis of the motor 164, and increase the torque by reducing a velocity of the motor 164.

In FIG. 8, two-stage reducer is shown.

The drum 166 may be connected to the reducer 165 and deliver a force outputted by the motor 164 to the belt 161. That is, the drum 166 may provide the force in a direction opposed to a direction the user pulling the handle 110.

The drum 166 may have a hollow shape, and the motor 164 may be inserted into a hollow part of the drum 166. As a result, the volume and the weight of the exercise equipment 100 may be minimized.

Figure 9:
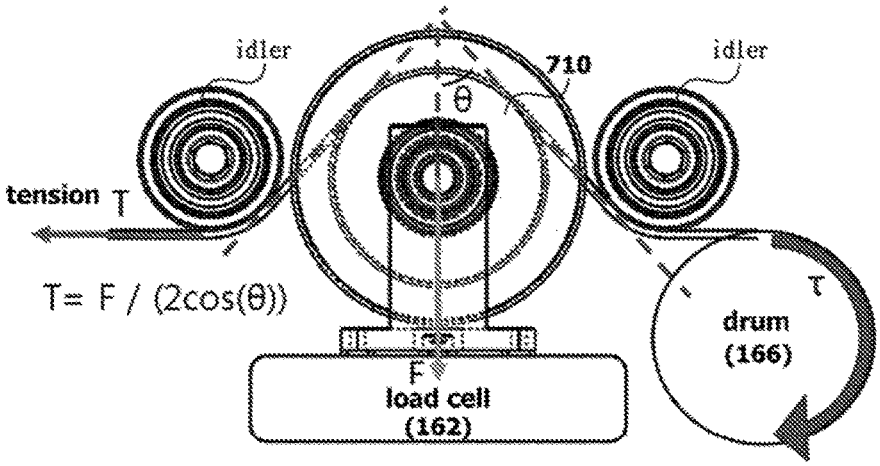
FIG. 9 is a view illustrating a tension measuring method of the load cell according to one embodiment of the invention.

FIG. 9 is a view illustrating a tension measuring method of the load cell according to one embodiment of the invention.

As shown in FIG. 9, the load cell 162 may measure the tension on the path of the belt 161 not an end part of the belt 161, thereby measuring easily the tension delivered to the belt 161 and enhancing accuracy of the measuring.

If the tension is measured on the belt connected to rotating drum, a wiring for a load cell signal is complicated. Moreover, a centrifugal force affects to the belt when the drum rotates, and so the accuracy of the measuring may be lowered.

If the load cell is installed on one terminal of the belt in opposed side and the tension is measured by the load cell, a wiring for a signal line moves together according as the belt moves. As a result, a measuring value of the load cell may be affected by the inertia in accordance with the moving.

A wireless method must be applied so as to solve the problem that the wiring for the signal line moves together according as the belt moves. In this case, delay of a signal must be predicted.

In the tension measuring structure of the invention shown in FIG. 9, a fixing sheave 710 is installed on the path of the belt 160, and the load cell 162 is equipped on a lower part of the fixing sheave 710. Hence, the tension measuring structure may measure easily the tension applied to the belt 161 passing via the fixing sheave 710 and minimize interference of factors affecting to the measuring value of the load cell, thereby enhancing the accuracy of the measuring value.

Figure 10:
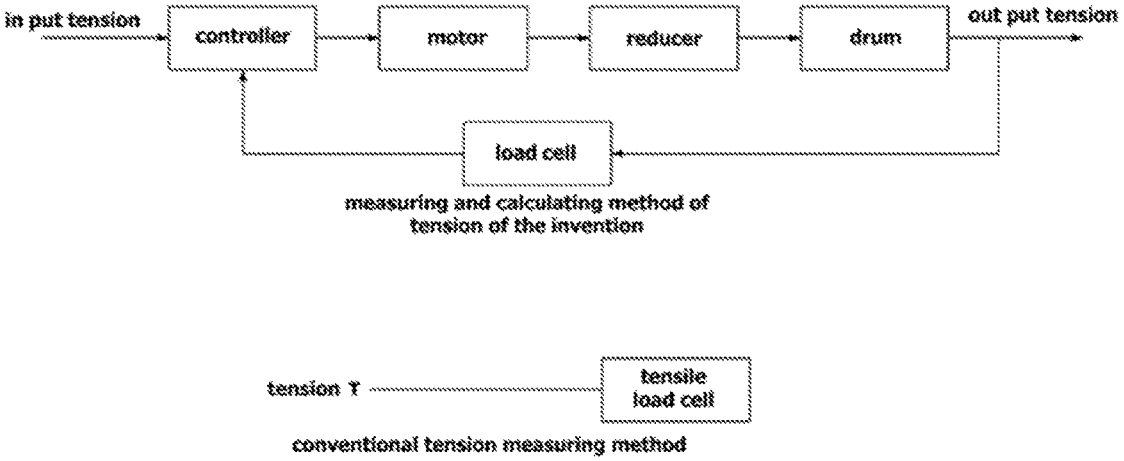
FIG. 10 is a view illustrating operation of the force control actuator 160 according to one embodiment of the invention.

FIG. 10 is a view illustrating operation of the force control actuator 160 according to one embodiment of the invention.

In conventional technique, tension is directly measured through a tension load cell as shown in FIG. 10. However, the force control actuator 160 may measure the tension by using the load cell 162 on the path of the belt 161 and the controller 163 may control the torque of the motor 164 by using the measured tension.

Figure 11:
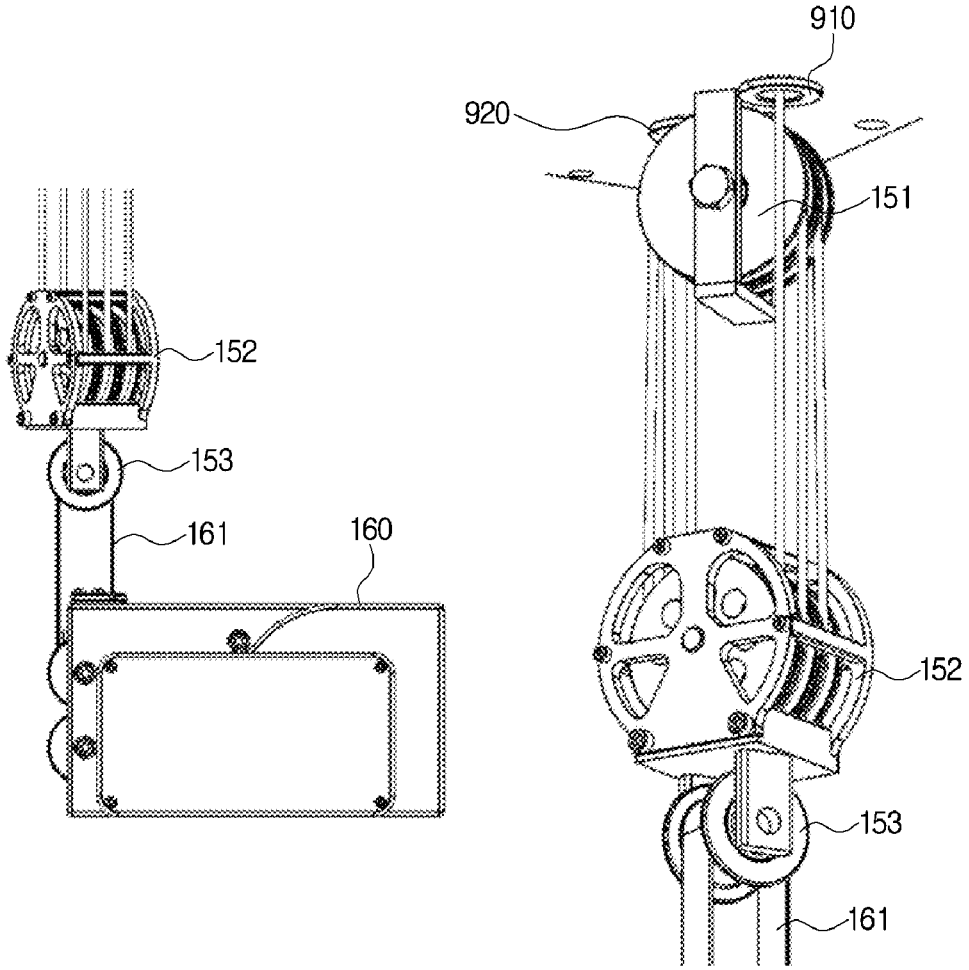
FIG. 11 and FIG. 12 are views illustrating inside structure of the post according one embodiment of the invention.
Figure 12:
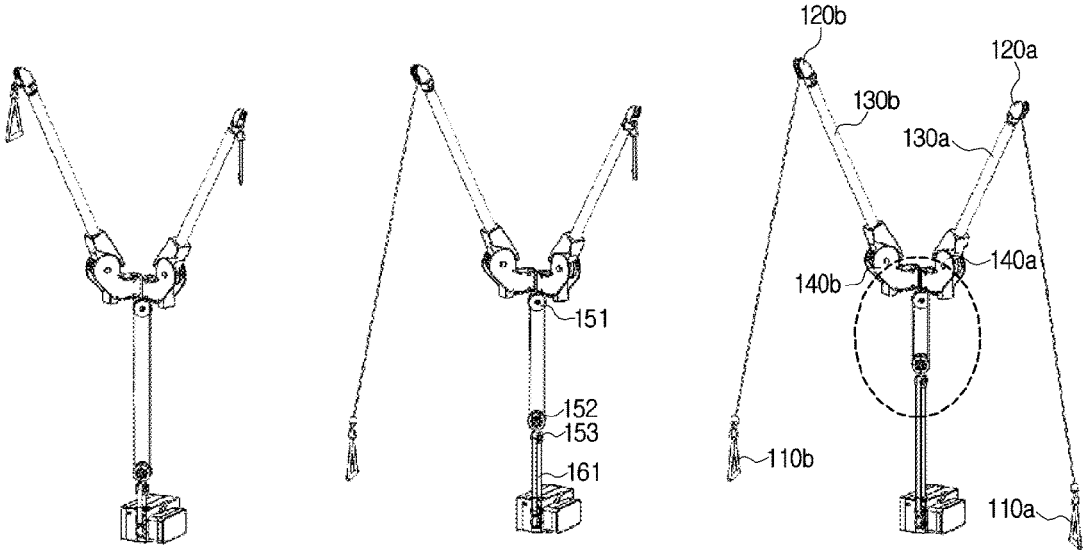

FIG. 11 and FIG. 12 are views illustrating inside structure of the post according one embodiment of the invention.

The post 150 is not shown for convenience of description. FIG. 9*a* shows a fixing sheave block 151 located in the post 150, an upper part moving sheave block 152 located below the fixing sheave block 151 and a lower part moving sheave 153 connected to a lower part of the upper part moving sheave block 152.

In FIG. 11 and FIG. 12, the fixing sheave block 151 may include two fixing sheaves, and the upper part moving sheave block 152 may include three moving sheaves.

Referring to FIG. 11 and FIG. 12, the path of the wire follows:

First handle 110*a*→first hand 120*a*→first arm 130*a*→first shoulder 140*a*→passing through a first pin 910 having a hollow shaft for connecting the first shoulder 140*a* to the post 150→passing the upper part moving sheave block 152 by one time→passing the fixing sheave block 151 by one time→passing again the upper part moving sheave block 152 by one time→passing the fixing sheave block 151 by one time→passing again the upper part moving sheave block 152 by one time→passing through a second pin 820 having a hollow shaft for connecting a second shoulder 140*b* to the post 150→the second shoulder 140*b*→second arm 130*b*→second hand 120*b*→second handle 110*b*

A belt 161 of the force control actuator 160 passes via the lower part moving sheave 153 connected to the lower part of the upper part moving sheave block 152.

Accordingly, a force applied to the wire by the user pulling at least one of the first handle 110*a* and the second handle 110*b* may be delivered to the belt 161, and a force corresponding to weight and velocity inputted through the touch panel 170 by the user may be also delivered to the wire through the belt 161. That is, the force may be applied in a direction opposed to a direction the user pulling the handle 110.

In FIG. 11, the velocity and stroke may increase with ratio of 2:6, and the weight may reduce.

That is, the force may be amplified by six times according as the wire connected to the handle passes via three moving sheaves and two fixing sheaves. The belt 161 of the force control actuator 160 passes via the lower part moving sheave 153 without passing directly via three moving sheaves, i.e. upper part moving sheave block 152, the wire may be pulled with a force corresponding to two times of a force generated by the force control actuator 160.

Number of the fixing sheave and the moving sheave included in the fixing sheave block and the upper part moving sheave block is not limited as in the above embodiments, and it may be variously applied depending on embodiments.

Figure 13:
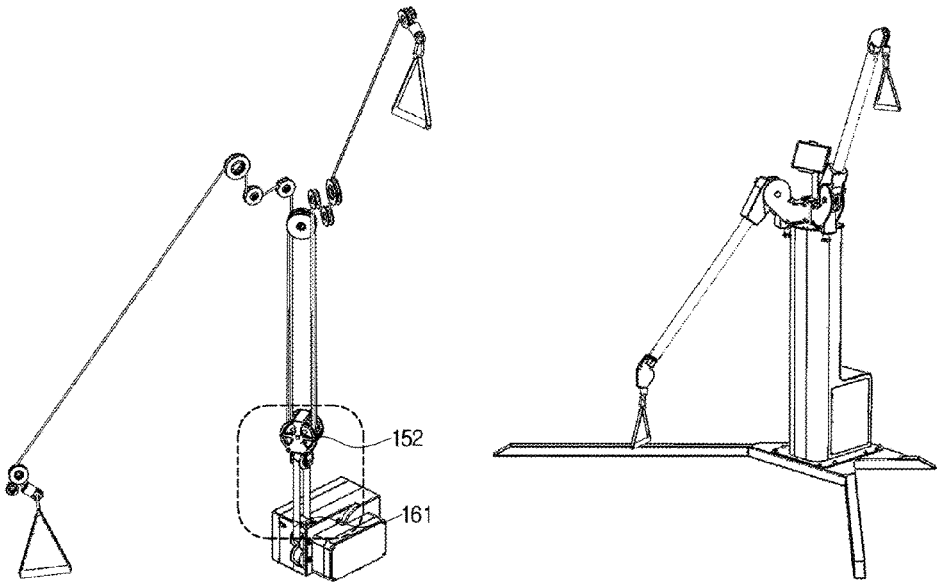
FIG. 13 and FIG. 14 are views illustrating a path of the wire and disposition of the sheave according to one embodiment of the invention.
Figure 14:
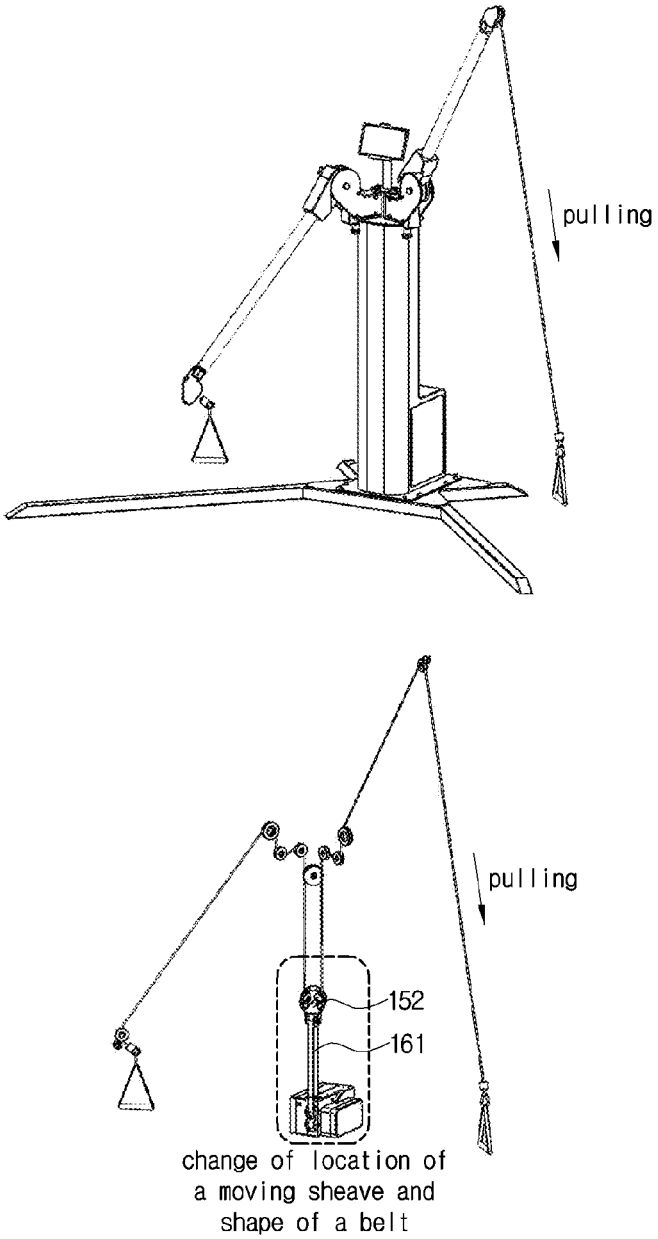

FIG. 13 and FIG. 14 are views illustrating a path of the wire and disposition of the sheave according to one embodiment of the invention.

FIG. 13 shows the path of the wire and disposition of the sheave while the arm 130 and the shoulder 140 rotate by a specific angle.

The user may verify location of the upper part moving sheave block 152 and the lower part moving sheave 153 and a shape of the belt 161 of the force control actuator 160, before he pulls the handle 110.

FIG. 14 illustrates a path of the wire and disposition of the sheave under the condition that the handle in FIG. 13 is pulled.

It is verified that location of the upper part moving sheave block 152 and the lower part moving sheave 153 and the shape of the belt 161 of the force control actuator 160 are changed, according as the user pulls the handle 110.

Although embodiments have been described with reference to a number of illustrative embodiments thereof, it should be understood that numerous other modifications and embodiments can be devised by those skilled in the art that will fall within the spirit and scope of the principles of this disclosure.

The embodiments of the invention described above are disclosed only for illustrative purposes, but are not limited.

More particularly, various variations and modifications are possible in the configuration parts and/or arrangements of the subject combination arrangement within the scope of the disclosure, the drawings and the appended claims.

Effect of developing and improving the exercise equipment may be obtained.

The invention claimed is:

1. An exercise equipment comprising:

a post which is a main body of the exercise equipment;

a shoulder installed on an upper side of the post and configured to rotate in left and right directions;

an arm combined with the shoulder and configured to rotate in up and down directions;

a hand combined with one terminal of the arm and configured to rotate by using the arm as an axis;

a handle located on one terminal side of the hand;

a force control actuator configured to output a force corresponding to a weight set by a user; and a wire configured to pass via plural sheaves included in the hand, the shoulder and the post and deliver a force generated by pulling of the handle, one terminal of the wire being connected to the handle, wherein the post includes a fixing sheave block fixed in the post, an upper part moving sheave block located below the fixing sheave block and a lower part moving sheave connected to a lower part of the upper part moving sheave block, wherein the wire passes via the fixing sheave block by one or more times and passes via the upper part moving sheave block by one or more times, and a belt of the force control actuator passes via the lower part moving sheave, wherein the hand includes plural fixing sheaves, and the wire passes through the arm and is connected to the handle via the fixing sheave, and wherein the wire passes via at least one fixing sheave according to a direction in which the handle is pulled, the fixing sheaves includes a first fixing sheave passed firstly by the wire passing through the arm and a second fixing sheave adjacent to the first fixing sheave, a diameter of the second fixing sheave is smaller than a diameter of the first fixing sheave, and the diameter of the second fixing sheave has a predetermined distance from a rotation axis of the hand in order to have an offset centering on the rotation axis of the hand.

2. An exercise equipment comprising:

a post which is a main body of the exercise equipment;

a shoulder installed on an upper side of the post and configured to rotate in left and right directions;

an arm combined with the shoulder and configured to rotate in up and down directions;

a hand combined with one terminal of the arm and configured to rotate by using the arm as an axis;

a handle located on one terminal side of the hand;

a force control actuator configured to output a force corresponding to a weight set by a user; and a wire configured to pass via plural sheaves included in the hand, the shoulder and the post and deliver a force generated by pulling of the handle, one terminal of the wire being connected to the handle, wherein the post includes a fixing sheave block fixed in the post, an upper part moving sheave block located below the fixing sheave block and a lower part moving sheave connected to a lower part of the upper part moving sheave block, wherein the wire passes via the fixing sheave block by one or more times and passes via the upper part moving sheave block by one or more times, and a belt of the force control actuator passes via the lower part moving sheave, wherein the arm and the shoulder are combined by a first pin having a hollow shaft and the arm rotates in up and down directions on the first pin, an up angle or a down angle of the arm is fixed by inserting a clamp into fixing holes formed respectively in a specific angle space on the arm and the shoulder, the shoulder is combined with the post by using a second pin having a hollow shaft and rotates in left and right directions, and a left angle or a right angle of the shoulder is fixed by inserting a clamp into fixing holes formed respectively in a specific angle space on the shoulder and an upper side of the post, wherein the shoulder includes a first fixing sheave, a second fixing sheave and a third fixing sheave, and wherein the first fixing sheave is inserted by the first pin, a radius of the first fixing sheave is matched with an offset of a wire passing vertically from a rotation axis of the arm and the shoulder, the wire passes, from the post, the first fixing sheave via a lower part of the second fixing sheave after passing via an upper part of the third fixing sheave through the hollow shaft of the second pin, and a path of the wire wound on the upper part of the third fixing sheave through the hollow shaft of the second pin matches with a rotation axis of the shoulder.

* * * * *